United States Patent [19]

Unger

[11] Patent Number: 5,020,486

[45] Date of Patent: Jun. 4, 1991

[54] PARTITIONED POPPET VALVE MECHANISM SEPRATING INLET AND EXHAUST TRACTS

[76] Inventor: Paul T. Unger, Lot 9, Collie's Lane, Mardi, NSW 2259, Australia

[21] Appl. No.: 592,216

[22] Filed: Oct. 3, 1990

[51] Int. Cl.[5] ..... F01L 1/28

[52] U.S. Cl. ..... 123/79 R; 123/188 VA

[58] Field of Search ..... 123/90.1, 79 R, 79 C, 123/188 A, 188 AA, 188 VA

[56] References Cited

U.S. PATENT DOCUMENTS

| | | | |
|---|---|---|---|
| 935,323 | 9/1909 | Petsche | 123/79 C |
| 2,191,745 | 2/1940 | Barkeij | 123/79 C |
| 2,720,873 | 10/1955 | Pick | 123/79 C |
| 2,799,266 | 7/1957 | kinman | 123/188 VA |
| 3,180,327 | 4/1965 | Neir | 123/79 R |
| 3,424,139 | 1/1969 | Brooks | 123/79 R |
| 3,757,757 | 9/1973 | Bastenhof | 123/188 VA |

FOREIGN PATENT DOCUMENTS

| | | | |
|---|---|---|---|
| 1119594 | 12/1961 | Fed. Rep. of Germany VA | 123/188 |
| 416069 | 10/1910 | France | 123/79 R |
| 483188 | 6/1917 | France | 123/79 R |
| 0153907 | 9/1984 | Japan | 123/79 R |

*Primary Examiner*—David A. Okonsky
*Assistant Examiner*—Weilun Lo
*Attorney, Agent, or Firm*—Ostrolenk, Faber, Gerb & Soffen

[57] ABSTRACT

A valve mechanism for a reciprocating piston internal combustion engine having one large poppet valve per cylinder communicating with both inlet and exhaust tracts. A partition between the inlet and exhaust tracts has gas flow ports therethrough moving into and out of alignment with similar gas flow ports in the valve stem. The ports are arranged to permit gas flow from the inlet tract to the outlet tract when the valve is closed.

6 Claims, 4 Drawing Sheets

PARTITIONED POPPET VALVE MECHANISM SEPRATING INLET AND EXHAUST TRACTS

This invention relates to a valve mechanism and has been devised for use in controlling the flow of inlet and exhaust gases to the combustion chamber of a reciprocating piston internal combustion engine.

BACKGROUND OF THE INVENTION

In the past many arrangements have been proposed to control the flow of inlet gases into, and exhaust gases from, the combustion chamber of an internal combustion engine. The conventional arrangement has a pair of reciprocating poppet valves in the head of the combustion chamber, one valve controlling the flow of gases from the inlet tract into the combustion chamber, and the other valve controlling the flow of exhaust gases from the combustion chamber to the exhaust tract after combustion. Such arrangements have limitations in that the valve diameter and therefore the area available for flow of the gases is restricted due to the necessity to fit at least two valves into the head of the combustion chamber, and this restriction limits the amount of inlet gases that can be induced into the engine and therefore restricts the power of the engine.

It is a further feature of existing valve mechanisms for internal combustion engines, that the flow of inlet gases is completely stopped once in every cycle requiring the gases to be quickly accelerated once the inlet valve has opened. The inertia of the gas also restricts the amount of gas that can be induced into the combustion chamber during the inlet phase of the operating cycle.

SUMMARY OF THE INVENTION

Accordingly the present invention provides a valve mechanism for a reciprocating piston internal combustion engine having one or more combustion chambers, said mechanism comprising a single poppet valve having a head and a stem for each combustion chamber, said valve being actuated by a drive mechanism to move between open and closed positions at predetermined times in the operating cycle of the piston, an inlet tract arranged to supply inlet gases to one side of the upper face of the poppet valve, an exhaust tract arranged to remove exhaust gases from the opposite side of the face of the poppet valve, a partition separating the inlet and exhaust tracts and having one or more gas flow ports therethrough, one or more gas flow ports in the stem of the valve arranged to align with the ports in the partition when the valve is closed permitting gases to flow from the inlet tract through the aligned ports and out the exhaust tract, and non-return valves in the inlet and exhaust tracts allowing gases in the inlet tract to flow only toward the valve, and gases in the exhaust tract to flow only away from the valve.

Preferably the stem of the poppet valve incorporates an enlarged portion in which the gas flow ports are located.

Preferably the gas flow ports in the valve stem permit gas flow both transversely through the stem and also axially, exiting from the end of the enlarged portion of the stem into the exhaust tract.

Preferably the partition comprises a semi-circular, part cylindrical wall, surrounding one half of the enlarged portion of the poppet valve.

Preferably the non-return valves comprise reed valves located in the inlet and exhaust tracts adjacent the poppet valve.

In one form of the invention, the valve mechanism is used in conjunction with a reciprocating piston in the combustion chamber, the piston being provided with a recess in the head thereof corresponding to the size and shape of the head of the poppet valve.

DESCRIPTION OF THE DRAWINGS

Notwithstanding any other forms that may fall within its scope, one preferred form of the invention will now be described by way of example only with reference to the accompanying drawings, in which.

DESCRIPTION OF THE PREFERRED EMBODIMENT

In the preferred form of the invention a valve mechanism is provided incorporating a poppet valve (1) having a head (2) and a stem (3). The head of the valve is provided with ground seating surfaces (4) which mate with corresponding surfaces in the cylinder head of the engine as is well known in poppet valve design.

Figure 1:
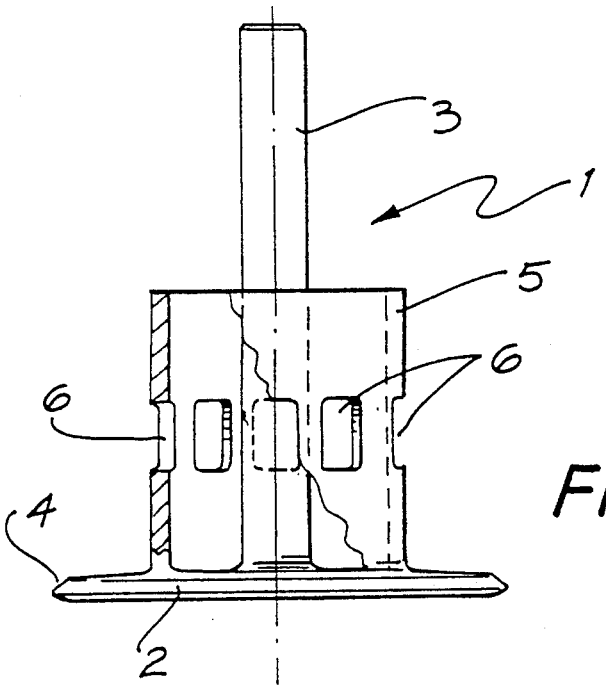
FIG. 1 is a partially cut away side view of a poppet valve for use in a valve mechanism according to the invention.

The stem of the valve is provided with an enlarged portion (5) toward the head of the valve which typically comprises a hollow cylinder as can be most clearly seen in FIG. 1 through which are formed a plurality of gas flow ports (6).

The poppet valve is configured to work in a cylinder head (7) (FIG. 2) having a valve guide (8) adapted to receive the valve stem (3), an inlet tract (9) and an exhaust tract (10). The cylinder head is provided with valve seating surfaces (11) adapted to mate with the surfaces (4) on the head of the valve.

The inlet and exhaust tracts are separated by a partition (12) having one or more gas flow ports (13) therethrough.

Figure 2:
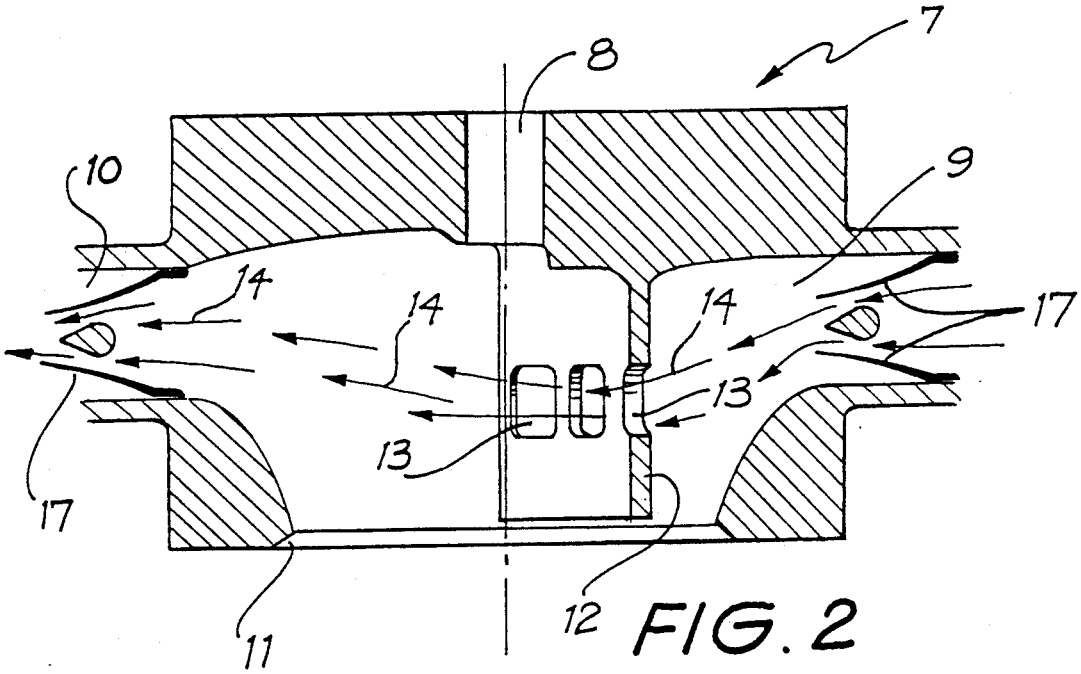
FIG. 2 is a vertical section through part of a cylinder head in which the poppet valve shown in FIG. 1 is located.
Figure 3:
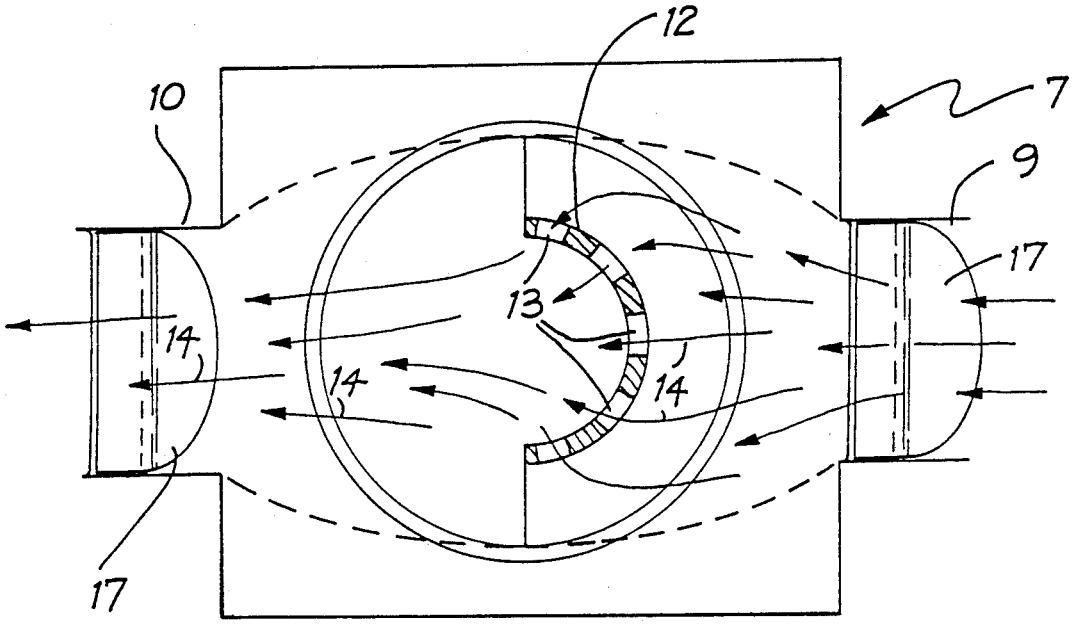
FIG. 3 is a diagrammatic horizontal section of the cylinder head shown in FIG. 2.

When the valve is removed from the cylinder head (as shown in FIGS. 2 and 3), gases are free to flow in through the inlet tract (9), through the gas flow ports (13) in the partition (12), and out through the exhaust tract (10) as shown by arrows (14).

Figure 4:
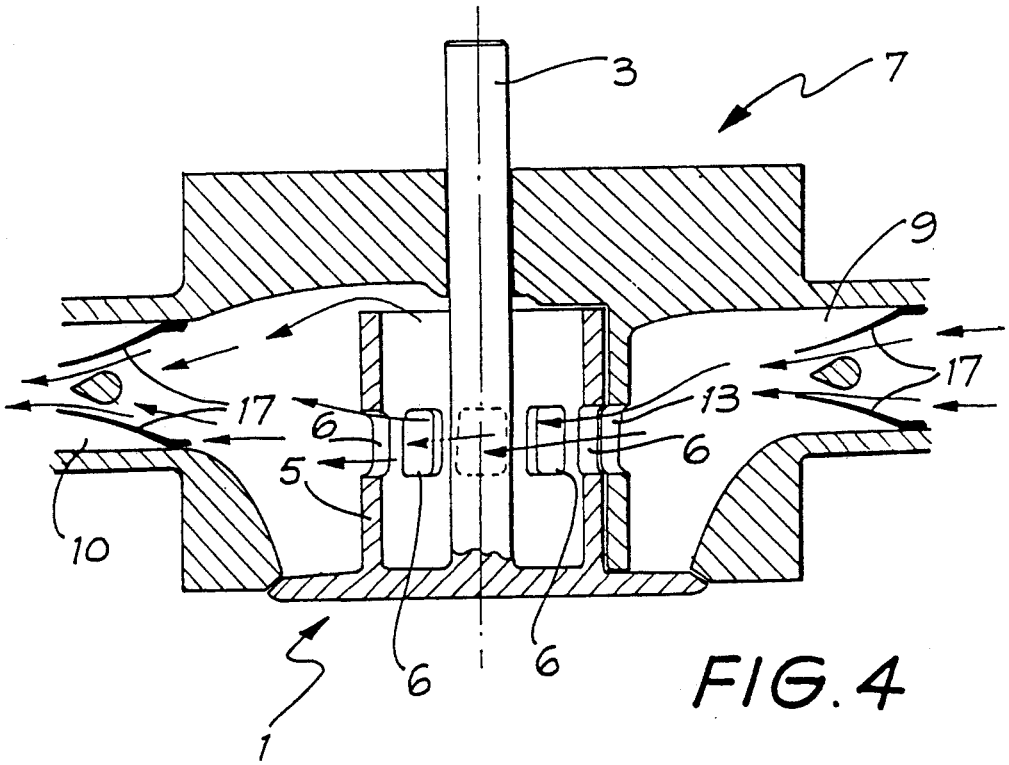
FIG. 4 is a diagrammatic cross-sectional elevation of the poppet valve assembled in the cylinder head showing the valve in the closed position.
Figure 5:
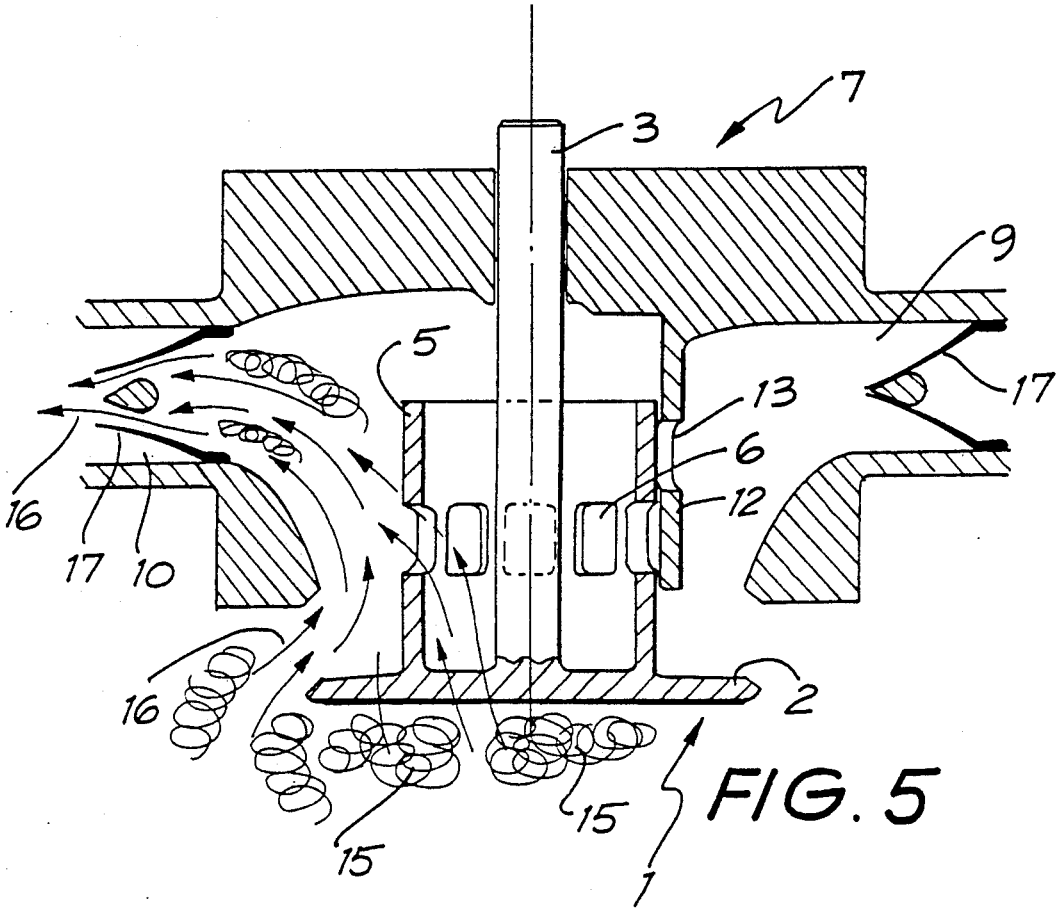
FIG. 5 is a similar view to FIG. 4 showing the valve in the first opened position allowing exhaust gases to escape from the combustion chamber.
Figure 6:
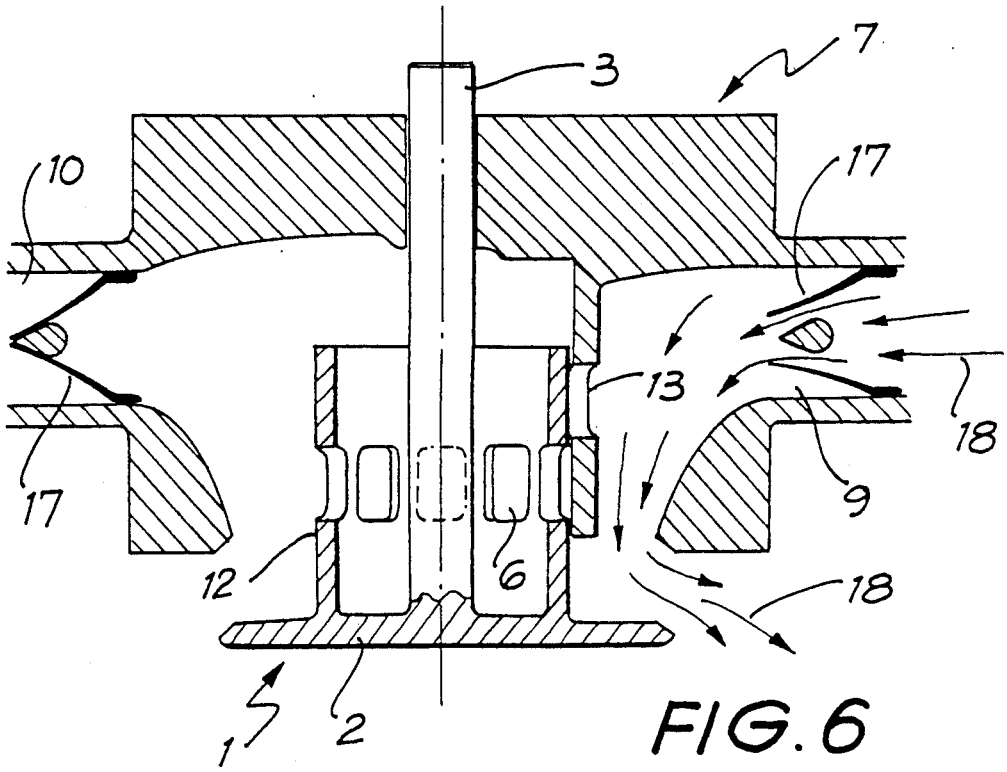
FIG. 6 is a similar view to FIG. 5 showing the entry of inlet gases.

When the poppet valve (1) is assembled into the head as shown in FIGS. 4 to 6, the gas flow ports (6) in the enlarged valve stem (5), align with the gas flow ports

(13) in the partition (12), when the valve is in the closed position as shown in FIG. 4. In this position, inlet gases entering through the inlet tract (9) can once again flow through the aligned ports in the partition and the enlarged valve stem and exit through the exhaust tract (10) in a similar manner to the gas flow through the head in the absence of the valve.

When the valve is opened by pushing the valve stem downward (in the sense shown in FIGS. 4 to 6) by a valve mechanism (not shown, but which typically comprises a conventional cam drive mechanism) the gas flow ports in the enlarged valve stem (5) move out of alignment with the gas flow ports (13) in the partition (12), preventing the flow of gases from the inlet tract (9) to the exhaust tract (10).

In the operating cycle of the engine, the combustion stroke is typically shown in FIG. 4 with the poppet valve (1) closed, sealing the combustion chamber from the inlet and exhaust tracts. As combustion finishes, the poppet valve is opened by the valve actuating mechanism to the position shown in FIG. 5, permitting exhaust gases (15) under pressure in the combustion chamber to flow out through the exhaust tract (10) as shown by arrows (16).

Both the inlet tract (9) and the exhaust tract (10) are provided with non-return valves, typically in the form of reed valves (17) of the type used in two-stroke motor cycle engines, permitting gases in the inlet tract to flow only toward the valve, and gases in the exhaust tract to flow only away from the valve. The reed valve in the inlet tract (9) prevents exhaust gases (15) from flowing out through the inlet tract into the induction passages of the engine.

Once the pressure of the exhaust gases drops below the pressure of gases in the inlet tract (9), the reed valve in the inlet tract opens permitting inlet gases to flow into the combustion chamber as shown by the arrows (18) in FIG. 6. As the piston begins to ascend in the compression stroke, the valve once again closes returning to the configuration shown in FIG. 4.

In this manner it is possible to induce inlet gases (which may simply comprise air for mixing with fuel injected directly into the combustion chamber, or which may comprise an air fuel mixture) into the combustion chamber, and also allowing exhaust gases to escape from the combustion chamber after combustion has taken place. It is a particular feature of the invention that the flow of air through the inlet tract (9) is not stopped by the closing of the poppet valve, allowing a constant flow of air through the inlet tract resulting in increased breathing efficiency of the engine as it is not necessary to accelerate and decelerate the air in the inlet tract as is the case with conventional prior art engines of this type.

Furthermore because it is necessary to have only one valve in the cylinder head, the valve can be made very large in size giving a large cross-sectional area between the valve seating surfaces when in the open position permitting free breathing of the engine and improved gas flow performance.

It is possible to achieve a very high degree of scavenging of exhaust gases from the combustion chamber of the engine by using the valve mechanism in conjunction with a piston (19) (FIG. 7) having a recessed crown (20) corresponding in shape and configuration to the head (2) of the valve (1). This configuration allows the valve to open completely even when the piston is at "top dead centre" position as shown in FIG. 8, almost completely evacuating all exhaust gases from the combustion chamber and permitting the use of radical cam profiles which would otherwise be impossible to use due to the danger of the valve head hitting the piston head.

Figure 9:
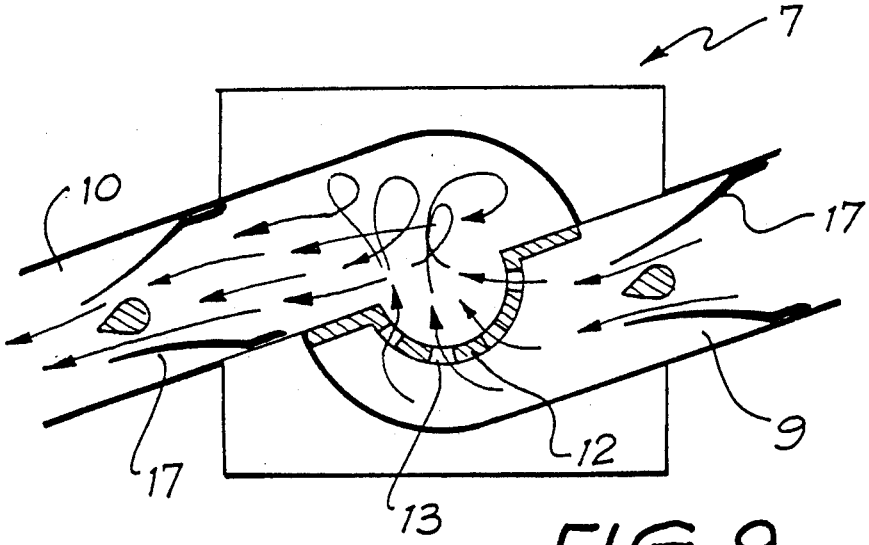
FIG. 9 is a diagrammatic plan view of an alternative preferred configuration of the inlet and exhaust tracts.

It is also possible to arrange the inlet and exhaust tracts in an offset configuration as shown in FIG. 9 to achieve improved mixing efficiency of the inlet gases due to induced swirl in the combustion chamber from the offset inlet tract (9).

The valve mechanism according to the invention not only improves breathing efficiency due to continuous air flow through the cylinder head and to the increased area for air flow due to the large size of the valve head but also has the advantage of reducing the temperature of the cylinder head due to the constant air flow and cooling effect of the inlet air. This configuration gives further advantages with turbo charged engines permitting an extremely high air flow capacity and high power outputs from small capacity highly efficient engines.

Figure 7:
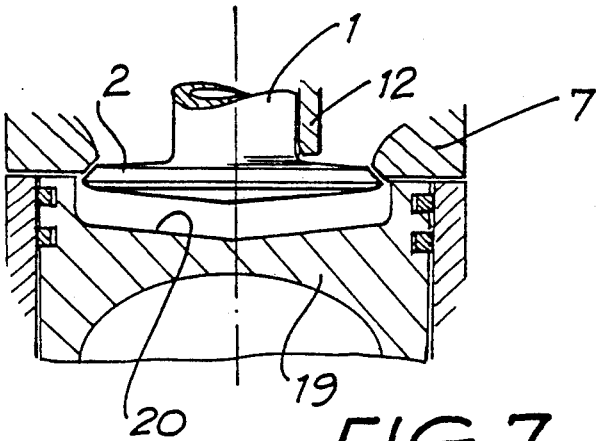
FIG. 7 is a scrap vertical cross-section showing the valve used in conjunction with a piston having a recessed head.
Figure 8:
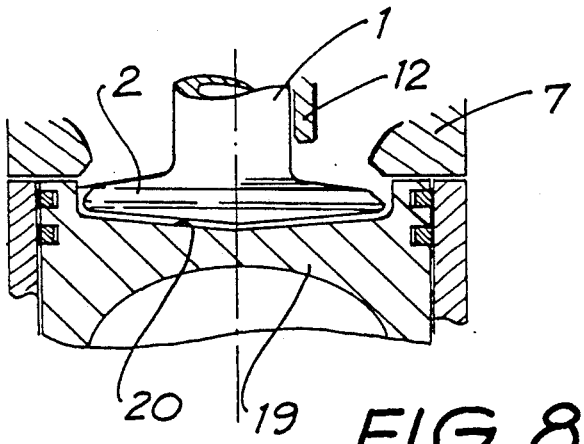
FIG. 8 is a similar view to FIG. 7 showing the valve in the open position.

By using the valve and piston configuration shown in FIGS. 7 and 8 it is also possible to use sophisticated valve actuation mechanisms which may leave selected valves open during low load conditions, effectively allowing a multiple cylinder engine to run on only one or two cylinders in idle, cruise, or other low load configurations giving resulting fuel savings and decrease in pollution emissions.

The ability to use variable valve mechanism also enables the valve mechanism to be used in either two, four or even eight stroke engines and to permit the use of much higher (or alternatively much lower) compression ratios than has hitherto been possible.

What I claim is:

1. A valve mechanism for a reciprocating piston internal combustion engine having one or more combustion chambers, said mechanism comprising a single poppet valve having a head and a stem for each combustion chamber, said valve being actuated by a drive mechanism to move between open and closed positions at predetermined times in the operating cycle of the piston, an inlet tract arranged to supply inlet gases to one side of the upper face of the poppet valve, an exhaust tract arranged to remove exhaust gases from the opposite side of the face of the poppet valve, a partition separating the inlet and exhaust tracts and having one or more gas flow ports therethrough, one or more gas flow ports in the stem of the valve arranged to align with the ports in the partition when the valve is closed permitting gases to flow from the inlet tract through the aligned ports and out the exhaust tract, and non-return valves in the inlet and exhaust tracts allowing gases in the inlet tract to flow only toward the valve, and gases in the exhaust tract to flow only away from the valve.

2. A valve mechanism as claimed in claim 1 wherein the stem of the poppet valve incorporates an enlarged portion in which the gas flow ports are located.

3. A valve mechanism as claimed in claim 2 wherein the enlarged portion is hollow, having an open top communicating with the exhaust tract.

4. A valve mechanism as claimed in claim 1 wherein the partition comprises a semi-circular, part cylindrical wall, surrounding one half of the enlarged portion of the poppet valve.

5. A valve mechanism as claimed in claim 1 wherein the non-return valves comprise reed valves located in the inlet and exhaust tracts adjacent the poppet valve.

6. A valve mechanism as claimed in claim 1 wherein in conjunction with a reciprocating piston in the combustion chamber, the piston being provided with a recess in the head thereof corresponding to the size and shape of the head of the poppet valve.

* * * * *